United States Patent [19]

Kobayashi et al.

[11] Patent Number: 4,901,066

[45] Date of Patent: Feb. 13, 1990

[54] METHOD OF DRIVING AN OPTICAL MODULATION DEVICE

[75] Inventors: Yoshinori Kobayashi, Hirakata; Tsuyoshi Uemura, Higashiosaka; Yoshihiro Gohara, Toyono; Naohide Wakita, Kobe, all of Japan

[73] Assignee: Matsushita Electric Industrial Co., Ltd., Osaka, Japan

[21] Appl. No.: 132,883

[22] Filed: Dec. 9, 1987

[30] Foreign Application Priority Data

Dec. 16, 1986 [JP] Japan ..... 61-299405
Dec. 16, 1986 [JP] Japan ..... 61-299407

[51] Int. Cl.[4] ..... G09G 3/34

[52] U.S. Cl. ..... 340/805; 340/783; 340/784; 350/350 S

[58] Field of Search ..... 340/783, 784, 805, 765, 340/763; 350/350 S, 350 R, 331 R, 332, 333

[56] References Cited

U.S. PATENT DOCUMENTS 4,697,887 10/1987 Okada et al. ..... 350/350 S
4,715,688 12/1987 Harada et al. ..... 350/350 S
4,773,716 9/1988 Nakanowatari ..... 340/784
4,800,382 1/1989 Okada et al. ..... 340/784

FOREIGN PATENT DOCUMENTS 61-243430 10/1986 Japan .

OTHER PUBLICATIONS

SID 85 Digest (1985), pp. 131–134, "An Application of Chiral Smectic-C Liquid Crystal to a Multiplexed Large-Area Display", by T. Harada et al.

"Simple Matrix LCD using Convolution Scanning Method", Hiroaki IDENO, EID 86-22 (1986), pp. 25–28.

*Primary Examiner*—David K. Moore
*Assistant Examiner*—Jeffery A. Brier
*Attorney, Agent, or Firm*—Wenderoth, Lind & Ponack

[57] ABSTRACT

In a method of driving an optical modulation device via scanning lines and signal lines a "selection period" of each scanning line is divided into at least four division periods. A voltage applied to a pixel allows the pixel to become a first stable state of bistable states of the pixel during third and second division periods from the last division period, and to either become a second stable state of the bistable states or hold the first state during the last division period. The scanning lines are scanned sequentially while at least two sequential scanning lines thereof may be applied with a same selection voltage at the same time, thereby reducing a time required for rewriting all pixels.

15 Claims, 7 Drawing Sheets

DATA 106
DATA 107
S1
S2
S3
S4
n
n+1
n+2
n+3
Ts
15
16
17
18

FIG. 6(a)

| SELECTION SIGNAL 112 | SIGNAL 105 | OUTPUT OF MULTIPLEXER 62 |
|---|---|---|
| 0 | 0 | $V_0$ |
| | 1 | $4V_0$ |
| 1 | 0 | $5V_0$ |
| | 1 | 0 |

FIG. 6(b)

| OUTPUT OF LATCH 72 | SIGNAL 105 | OUTPUT OF MULTIPLEXER 73 |
|---|---|---|
| 0 | 0 | $2V_0$ |
| | 1 | $3V_0$ |
| 1 | 0 | 0 |
| | 1 | $5V_0$ |

METHOD OF DRIVING AN OPTICAL MODULATION DEVICE

BACKGROUND OF THE INVENTION

1. Field of Utilizing the Invention

This invention relates to a method of driving an optical modulation device such as a ferroelectric liquid crystal panel, which has a memory function and is used as a display device.

2. Description of the Prior Art

Recently, demand has increased for a thin, or flat, display device having a large display capacity in the field of information equipment represented by the computer and in the field of visual equipment represented by the television, video tape recorder and video disc player. The ferroelectric liquid crystal panel is an example of such a flat display device.

A matrix driving method for a ferroelectric liquid crystal panel, which is a slight modification of an in-field AC optimized amplitude selection scheme used for a nematic liquid crystal is shown in SID 85 DIGEST (1985), pp. 131–134, "An Application of Chiral Smetic-C Liquid Crystal to a Multiplexed Large-Area Display" by T. Harada et al. A one-display-area rewriting period (one frame) is divided into two fields different in polarity from each other, in which an on-state (or off-state) is set in a first field, and an off-state (or on-state) is set in a second field. In this method, however, off-pixels (or on-pixels) are not written in the first field, so that a flicker is noticeable and it takes a long time for rewriting the image in the whole display-area.

A method of scanning a plurality of scanning lines at the same time is shown in a Japanese paper "Simple Matrix LCD using Convolution Scanning Method", Hiroaki IDENO, EID 86-22 (1986), pp. 25–28. This method uses a convolution scanning method for driving a nematic liquid crystal display with a high contrast. However, this method would reduce resolution when applied to a ferroelectric liquid crystal.

Another method of scanning a plurality of scanning lines at the same time is shown in Japanese Patent Publication No. 61-243430 (1986), "Method of Driving a Ferroelectric Liquid Crystal Elements". This method divides the scanning lines into a plurality of blocks and drives the scanning lines block by block. This method requires a line memory capable of storing display data for the pixels connected to scanning lines in one block and a complicated driving circuitry.

SUMMARY OF THE INVENTION

An object of the present invention is to provide a method of driving an optical modulation device at a high rewriting rate without reducing resolution with a simple driving circuitry.

In a display apparatus in which an optical modulation material is sandwiched between scanning lines and signal lines to form pixels arranged in a matrix at respective overlapping portions of the scanning lines and signal lines, each pixel becomes one of its bistable states according to a voltage applied thereto (a voltage applied between a scanning line and a signal line connected thereto). More specifically, a voltage applied to a pixel produces an electric field which allows the pixel to become one of the bistable states according to an integral of the voltage with respect to time. The scanning lines are scanned to be selected sequentially in synchronization with a horizontal sync signal. A period during which each scanning line is selected is called a "selection period". During each selected period of a scanning line, the display states of pixels connected to the scanning line are renewed. For each scanning line, the period except for the selection period is called "non-selection period".

According to the present invention, each selection period ($T_S$) is divided into at least four division periods each ($\tau$) being at most a half of a horizontal scanning period (H) of the horizontal sync signal (i.e. $T_S \geqq 4\tau$, $H \geqq 2\tau$), and a voltage is applied to each pixel connected to a selected scanning line in such a manner that the pixel becomes a first stable state of the bistable states during third and second division periods from the last division period in the selection period and either becomes a second stable state of the bistable states or holds the first stable state during the last division period.

Preferably, the scanning lines are scanned to be selected sequentially in synchronization with the horizontal sync signal while at least two sequential scanning lines are selected at the same time. In other words, selection periods of at least two sequential scanning lines partly overlap each other in such a manner that the starting timing of a selection period of each scanning line is shifted by one horizontal scanning period from the starting timing of a selection period of an adjacent previous scanning line. More specifically, supposing the total number of scanning lines to be N, each selection period $T_S$ is made to be $T_S \geqq 2(k+1)\tau$ for selecting $k+1$ scanning lines at the same time (where k: any integer, $k << N$). The scanning lines are scanned so that $k+1$ scanning lines are selected at the same time in the sequence of first through k-th scanning lines, second through $(k+1)$-th scanning lines, third through $(k+2)$-th scanning lines, . . . , n-th through $(n+k)$-th scanning lines, . . . .

At this time, data to be displayed are inverted at every other horizontal scanning period before being converted to voltages applied to the signal lines.

During the non-selection period of each pixel, an alternating voltage that has alternately positive and negative valves is applied to the pixel so as to allow the pixel to hold a stable state established in a previous selection period until a next selection period.

The above and other object and features of the present invention will become more apparent from the following detailed description taken in connection with the accompanying drawings in which:

BRIEF DESCRIPTION OF THE DRAWINGS

FIGS. 6(*a*) and 6(*b*) are truth tables based on which analog multiplexers in scanning and signal line drivers in the apparatus of FIG. 4 operate respectively;

DESCRIPTION OF THE PREFERRED EMBODIMENTS

Figure 1:
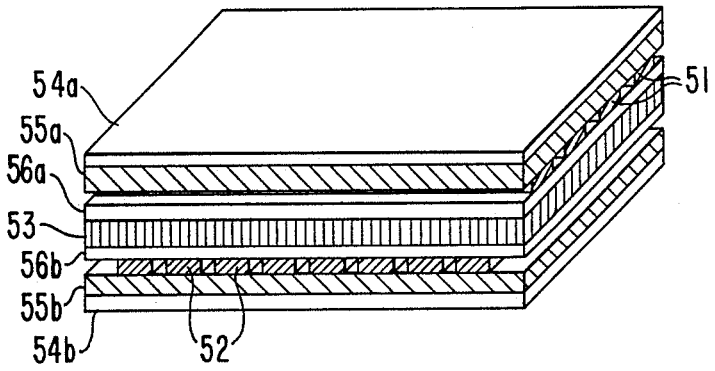
FIG. 1 is a schematic sectional view of a display panel using an optical modulation material.

FIG. 1 shows a schematic sectional view of a display panel using an optical modulation material usable in a display apparatus to which the present invention is applicable. Referring to FIG. 1, an optical modulation material layer 53 is sandwiched between two alignment layers (e.g. organic polymer films aligned by rubbing) 56*a* and 56*b*. Parallel scanning lines (scanning electrodes) 51 formed on a glass substrate 55*a* are provided on the alignment layer 56*a*, and parallel signal lines (signal electrodes) 52 formed on a glass substrate 55*b* are provided on the alignment layer 56*b*. The scanning lines are arranged perpendicularly to the signal lines. On outer surfaces of the glass substrates 55*a* and 55*b* are provided polarizing plates 54*a* and 55*b*, respectively. The portions where the scanning lines and the signal lines overlap become pixels. The optical modulation material may be such a material that has one of bistable molecular alignment states according to a voltage applied between a signal line and a scanning line. Since a visible light passed through the optical modulation material layer changes in polarization according the molecular alignment state of the material, the molecular alignment state can be seen through the polarizing plates 54*a* and 54*b* as a "dark" state or a "bright" state at each pixel portion.

A typical optical modulation material having the molecular alignment bistability is a ferroelectric liquid crystal showing chiral smectic C phase such as (+)-DOBAMBC ((+)-P-decyloxybenzylidene-P'-amino-2-methylbutylcinamate). The molecular alignment state changes from one of the bistable states to the other in response to an integral of a same polarity of applied voltage pulse with respect to time, i.e., an integral of applied voltage with respect to time from one polarity transition (from positive to negative or from negative to positive) to next polarity transition of the voltage.

Figure 2:
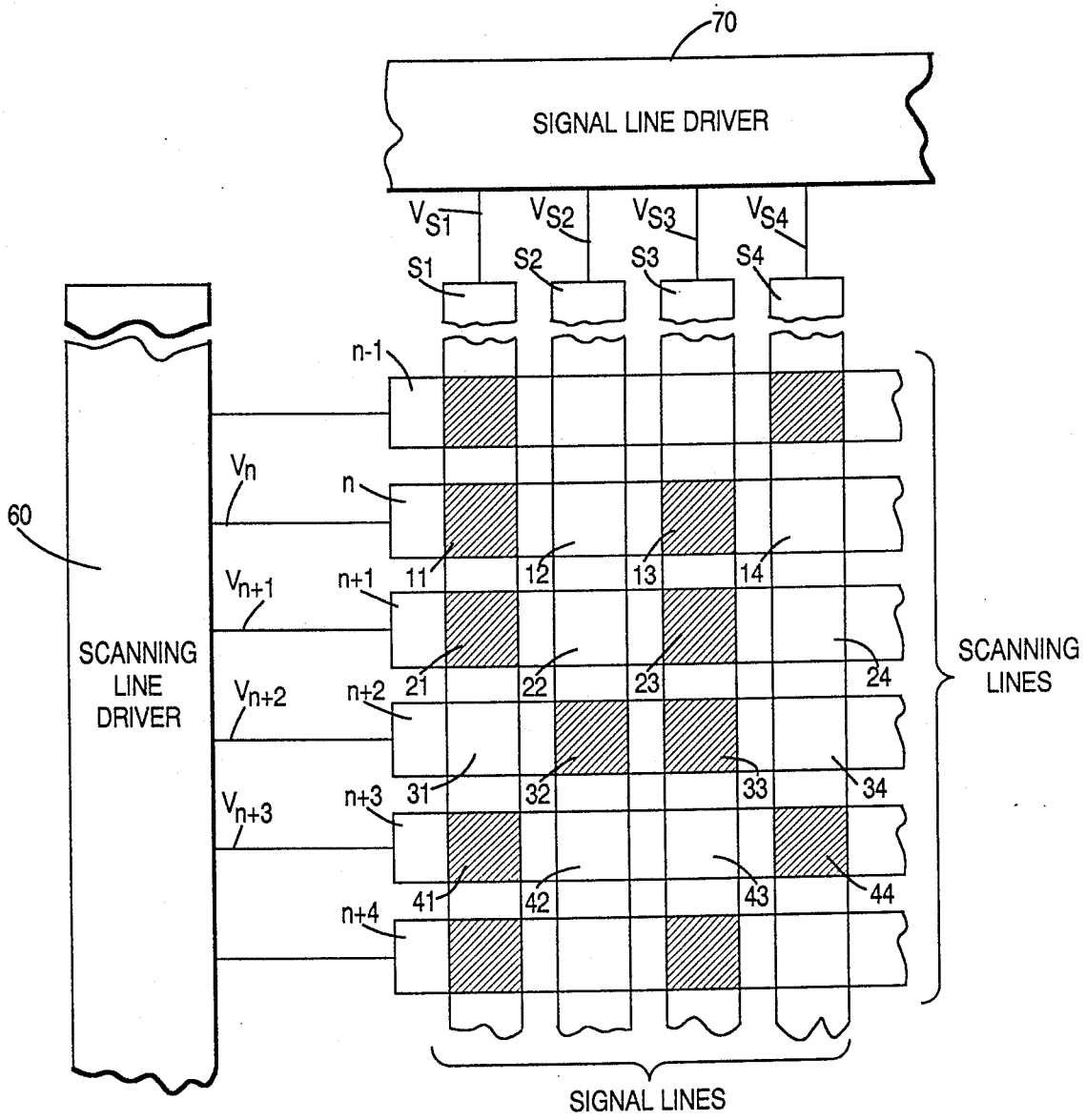
FIG. 2 is a schematic front view showing an arrangement of pixels and scanning and signal lines, in which an example of a displayed state is shown.

FIG. 2 is a schematic diagram showing partially an arrangement of the signal lines, scanning lines and pixels at the respective overlap portions of the signal and scanning lines. Signal lines S1, S2, S3, S4 are aligned in column, and scanning lines n−1, n, n+1, n+2, n+3, n+4 are aligned in row. Pixels responsive to the respective voltages between the signal lines S1 through S4 and the scanning lines n through n+3 are denoted by numerals 11, 12, 13, 14, 21, 22, 23, 24, 31, 32, 33, 34, 41, 42, 43, 44. A signal line driver 70 applies voltages $V_{S1}$, $V_{S2}$, $V_{S3}$ and $V_{S4}$ to the signal lines S1, S2, S3 and S4, respectively. A scanning line driver 60 applies voltages $V_n$, $V_{n+1}$, $V_{n+2}$ and $V_{n+3}$ to the scanning lines n, n+1, n+2 and n+3, respectively. Adjacent two scanning lines are selected at the same time in the sequence of (n, n+1), (n+1, n+2), (n+2, n+3) and (n+3, n+4). In FIG. 2, the black pixels are in a "dark" state and the white pixels are in a "bright" state.

Figure 3:
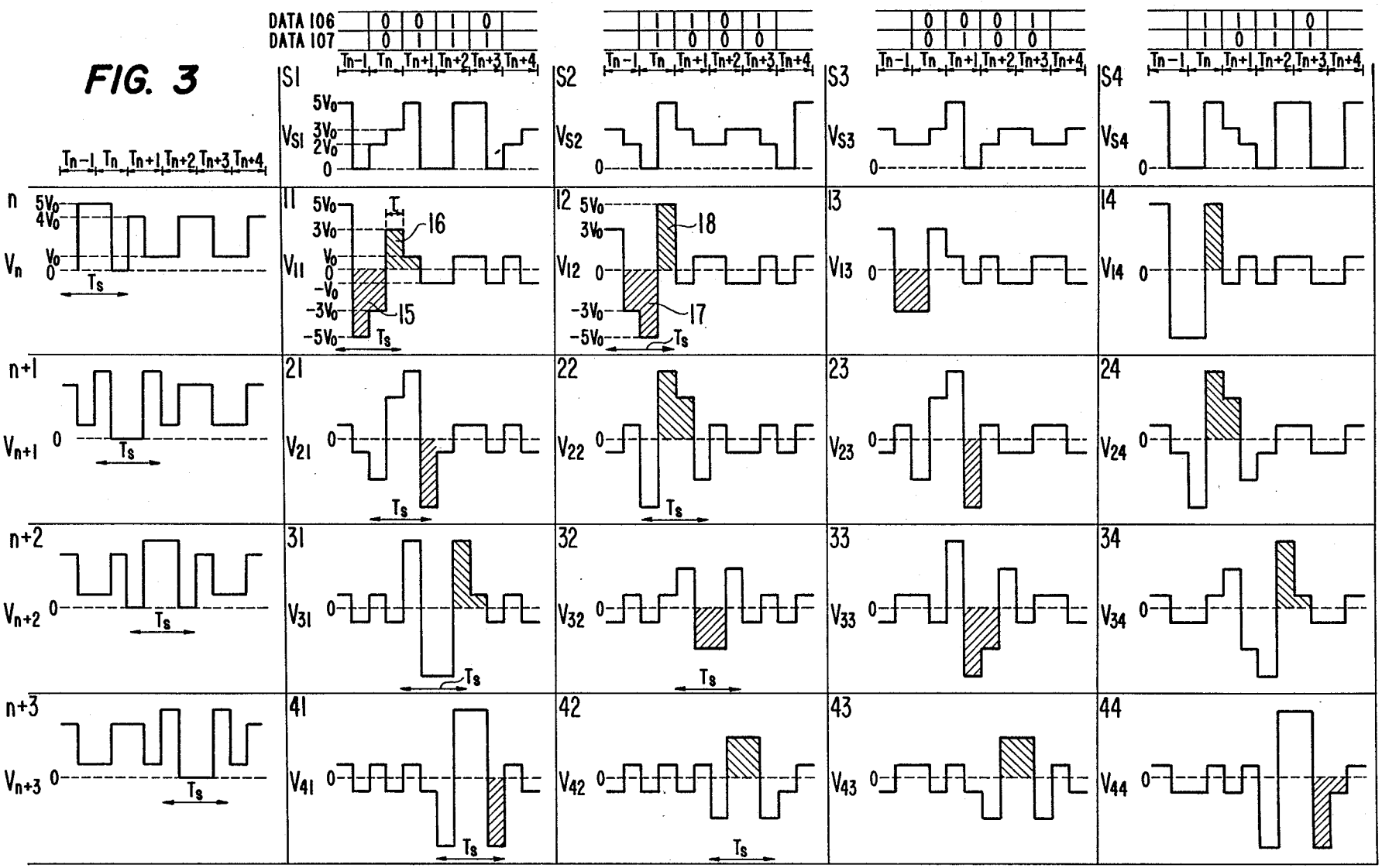
FIG. 3 is a waveform diagram showing waveforms of voltages applied to the scanning lines, signal lines and pixels, for realizing the displayed state of FIG. 2.

FIG. 3 is a voltage waveform diagram showing waveforms of the voltages applied to the signal lines, scanning lines and pixels for realizing the display state shown in FIG. 2. Voltage $V_{11}$ through $V_{14}$, $V_{21}$ through $V_{24}$, $V_{31}$ through $V_{34}$, $V_{41}$ through $V_{44}$ are applied to the pixels 11 through 14, 21 through 24, 31 through 34, 41 through 44, respectively. For example, the voltage $V_{11}$ applied to the pixel 11 is a voltage difference between the signal line S1 and the scanning line n, i.e., $V_{11}=V_{S1}-V_n$. Each of $T_{n-1}$, $T_n$, $T_{n+1}$, $T_{n+2}$, $T_{n+3}$, and $T_{n+4}$ is a horizontal scanning period. $T_S$ denotes a "selection period" in which each scanning line is selected for renewing data (display states) of the pixels connected thereto. Selection periods of adjacent two scanning lines partly overlap each other. For example, the selection periods of the scanning lines n and n+1 overlap in the horizontal scanning period $T_n$, and the selection periods of the scanning lines n+1 and n+2 overlap in the next horizontal scanning period $T_{n+1}$. In other words, each adjacent two scanning lines are selected at the same time.

Each selection periods $T_S$ is divided into four division periods each being $\tau$, i.e., $T_S=4\tau$. Each division period $\tau$ is a half of the horizontal scanning period H, i.e., $H=2\tau$. The starting timing of the selection period of the scanning line n+1 is delayed by H from the starting timing of the selection period of the scanning line n. This relationship can be applied to the selection periods of any two adjacent scanning lines.

Each of the voltages applied to the scanning lines has one of two values 0 and $5V_0$ (where $V_0$ is a unit value) in each of the four division periods in each selection period $T_S$, and alternately has one of two values $V_0$ and $4V_0$ during the non-selection period other than the selection period. Each of the voltages applied to the signal lines either has one of two values 0 and $5V_0$ in each of two division periods in each horizontal scanning period and changes from one of the values 0 and $5V_0$ to the other or has one of two values $2V_0$ and $3V_0$ in each of two division periods in each horizontal scanning period and changes from one of the values $2V_0$ and $3V_0$ to the other, according to data to be displayed.

Data to be displayed (data 106) is inverted in polarity in every other horizontal scanning period to become periodically-inverted data (data 107) before being converted to the voltages applied to the signal lines. For example, data 106 for displaying "dark" at pixel 11, "dark" at pixel 21, "bright" at pixel 31 and "dark" at pixel 41 as shown in FIG. 2 are "0", "0", "1" and "0"which occur in the continuous horizontal scanning periods $T_n$, $T_{n+1}$, $T_{n+2}$ and $T_{n+3}$ as shown in FIG. 3. The data in $T_{n+1}$ and $T_{n+3}$ are inverted to be "1" and "1", respectively. Thus, the data sequence 107 to be converted to the voltage $V_{S1}$ become "0111". The value of the voltage $V_{S1}$ changes according to the periodically-inverted data 107. For example, in $T_n$ when the data 107 is "0" the voltage $V_{S1}$ becomes $2V_0$ in the first division period in $T_n$ and $3V_0$ in the second division period in $T_n$. In $T_{n+1}$ when the data 107 is "1" the voltage $V_{S1}$ becomes $5V_0$ in the first division period in $T_{n+1}$ and 0 in the second division period in $T_{n+1}$. Generally, when the data 107 is "0" in a horizontal scanning period, a voltage applied to a signal line becomes one of values $2V_0$ and $3V_0$ in the first division period in the horizontal scanning period and changes to the other in the second division period. When the data 107 is "1", the voltage applied to the signal line becomes one of values 0 and $5V_0$ and then changes to the other in a horizontal scanning period.

Applications of voltages to the signal and scanning lines in the way described above allow the voltages applied to the pixels to become as follows. That is, a voltage applied to a pixel makes the pixel to become a first state (one of "bright" and "dark" states) in the third and second division periods counted from the last division period among the four division periods in a selection period $T_S$, and then makes the pixel to either hold the first state or change to a second state (the other of "bright" and "dark" states) in the last division period. This will be described in more detail below.

The voltage applied to a pixel is divided into four voltage pulses occuring in respective four division periods in each selection period $T_S$. Thus, the pulse width of each voltage pulse is $\tau$. Suppose that each pixel becomes "bright" state when the value of the integral of continuous same polarity voltage pulses applied thereto with respect to time is $5V_0 \cdot \tau$ or more, becomes "dark" state when the value of the integral is $-5V_0 \cdot \tau$ or less, and holds a previous state when the absolute value of the integral is less than $5V_0 \cdot \tau$. Referring to the waveform of voltage $V_{11}$ applied to pixel 11 in FIG. 3, the value of the integral (15) of voltage pulses with respect to time in the third and second division periods from the last division period in the selection period $T_S$ is $(-5V_0 \cdot \tau)+(-3V_0 \cdot \tau)=-8V_0 \cdot \tau(<-5V_0 \cdot \tau)$, so that the pixel 11 becomes "dark" state. The value of the integral (16) of voltage pulses in the last division period in $T_S$ and the next voltage pulse is $3V_0 \cdot \tau + V_0 \cdot \tau = 4V_0 \cdot \tau(<5V_0 \cdot \tau)$, so that the pixel 11 holds "dark" state. Since the value of the integral of same polarity voltage pulses during the nonselection period is $2V_0 \cdot \tau$ at maximum, the pixel 11 holds "dark" state established during the selection period. Referring to the waveform of voltage $V_{12}$ applied to pixel 12 in FIG. 3, the value of the integral (17) of voltage pulses with respect to time in the third and second division periods from the last division period in the selection period $T_S$ is $(-3V_0 \cdot \tau)+(-5V_0 \cdot \tau)=-8V_0 \cdot \tau$, so that the pixel 12 becomes "dark" state. The value of the integral (18) of voltage pulse in the last division period in $T_S$ is $5V_0 \cdot \tau$, so that the pixel 12 becomes "bright" state, which is held until next selection period. In the same way, the states of the other pixels are established by the values of the integrals of voltage pulses indicated by hatching in FIG. 3.

Since the state of each pixel is determined by the voltage pulses in the last three division periods in each selection period, each selection period may be divided into more than three even number of division periods. Thus, the number of the division periods may not be limited to four, but may be six, eight or more. In general, for selecting $k+1$ scanning lines among total N scanning lines, the selection period $T_S$ may be made to be as $T_S \geqq 2(k+1)\tau$ while maintaining the previously described condition of $H \geqq 2\tau$, i.e., $T_S$ may be divided into at least $2(k+1)$ division periods each being $\tau$. Even if the number of division periods is increased, the state of each pixel is established during the last three division periods in each selection period. In this method, the time required for renewing the display states of all pixels of the display panel can be reduced without deterioration of resolution.

Figure 4:
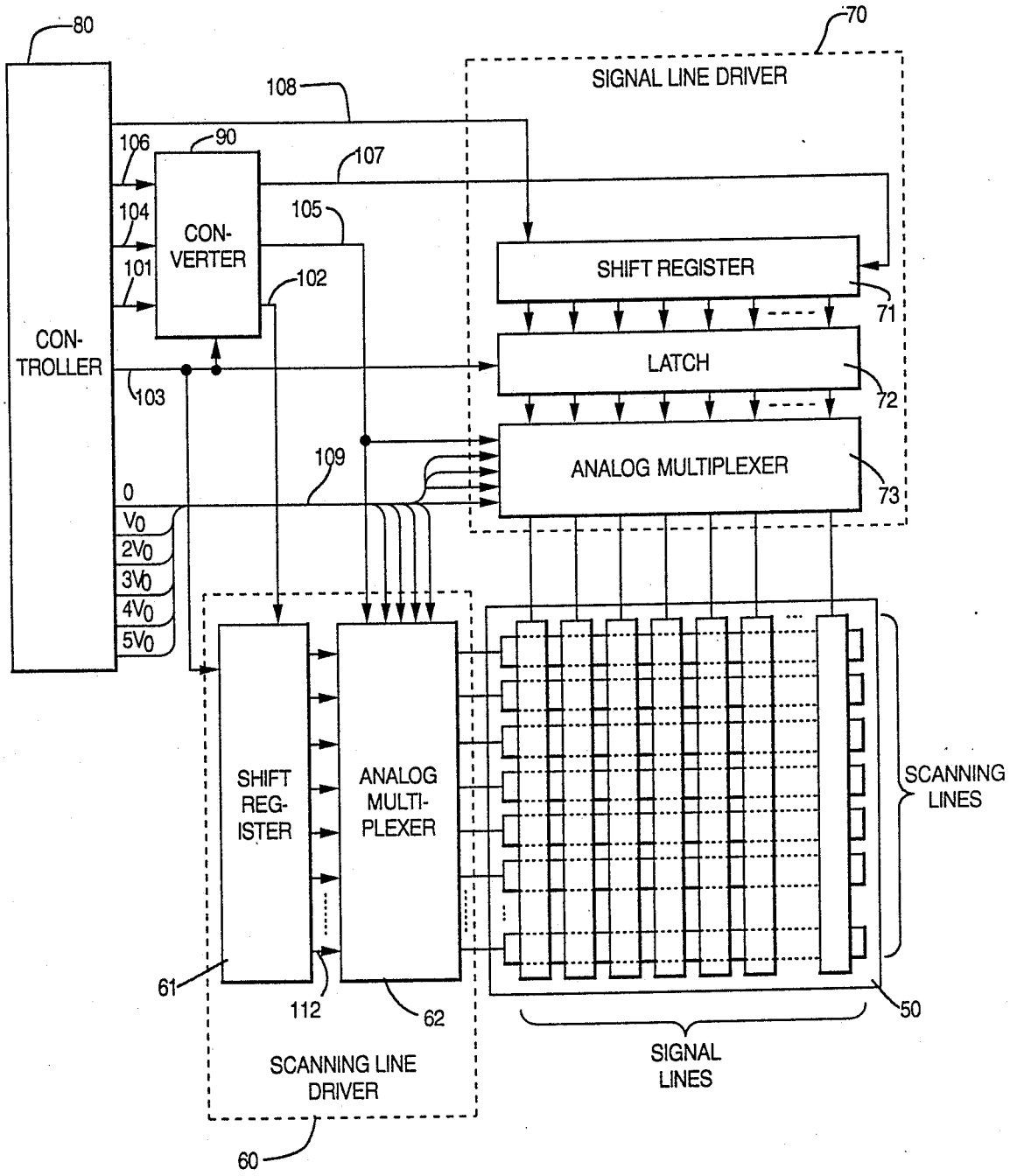
FIG. 4 is a schematic block diagram showing a display apparatus for producing the voltages shown in FIG. 3.
Figure 5:
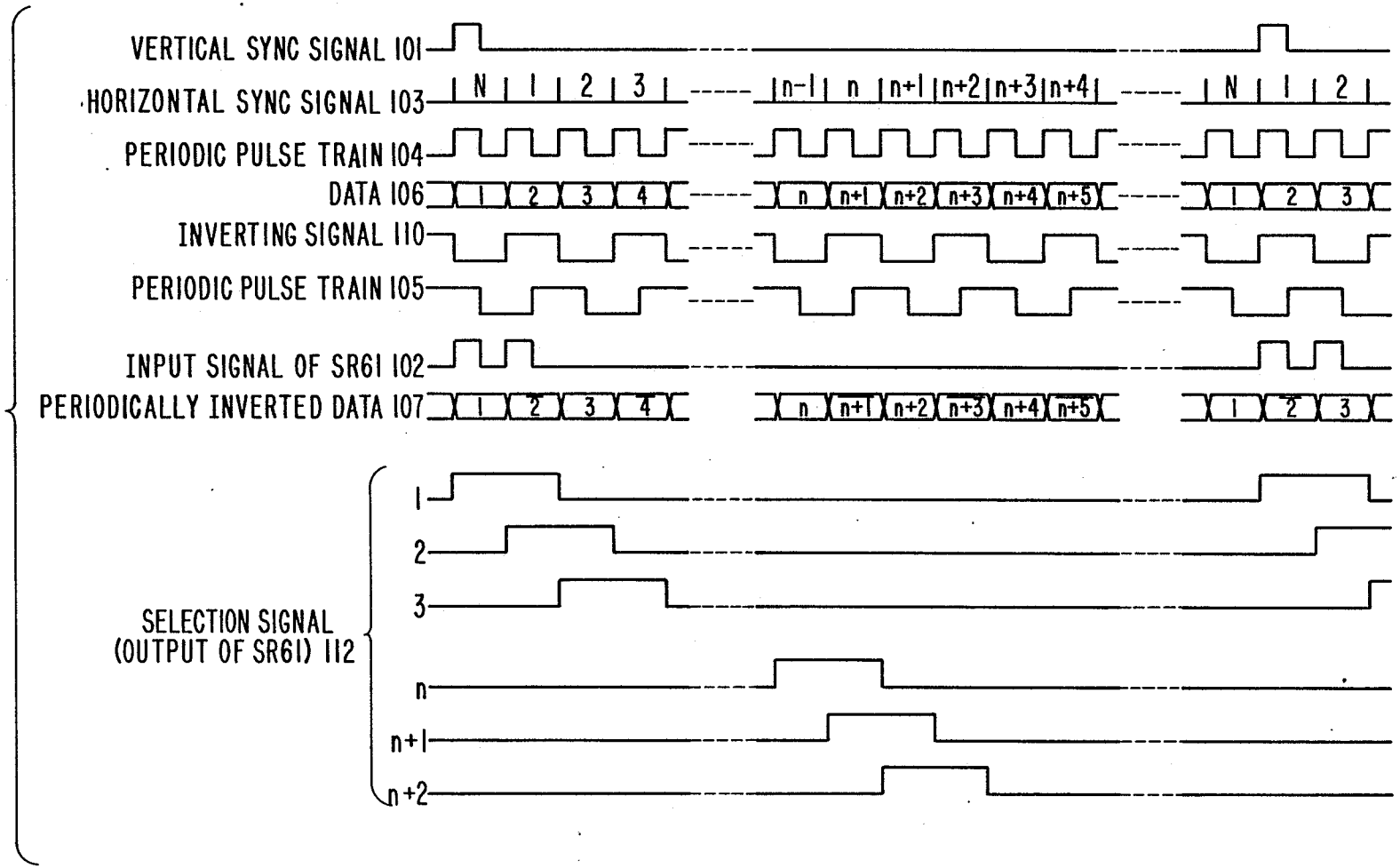
FIG. 5 is a signal timing chart for explaining the operation of the apparatus of FIG. 4.

FIG. 4 is a block diagram showing an example of display apparatus for realizing the above-described driving method of the invention, and FIG. 5 shows a timing chart of signals in the apparatus of FIG. 4. Reference numeral 50 denotes the display panel in which only the scanning lines and signal lines are shown for simplicity. A controller 80 produces a vertical sync signal 101, a horizontal sync signal 103, a periodic pulse train 104 synchronized with the horizontal sync signal, data 106 to be displayed (each of data block 1, 2, 3,—in FIG. 5 is for pixels connected to each scanning line), a clock signal 108 having the number of clocks in each horizontal scanning period corresponding to the number of pixels connected to each scanning line, and six kinds of driving voltages (0, $V_0$, $2V_0$, $3V_0$, $4V_0$ and $5V_0$) 109. Among the six kinds of driving voltages, four kinds of driving voltages 0, $2V_0$, $3V_0$ and $5V_0$ are fed to the signal line driver 70, and four kinds of voltages 0, $V_0$, $4V_0$ and $5V_0$ are fed to the scanning line driver 60.

Figure 7:
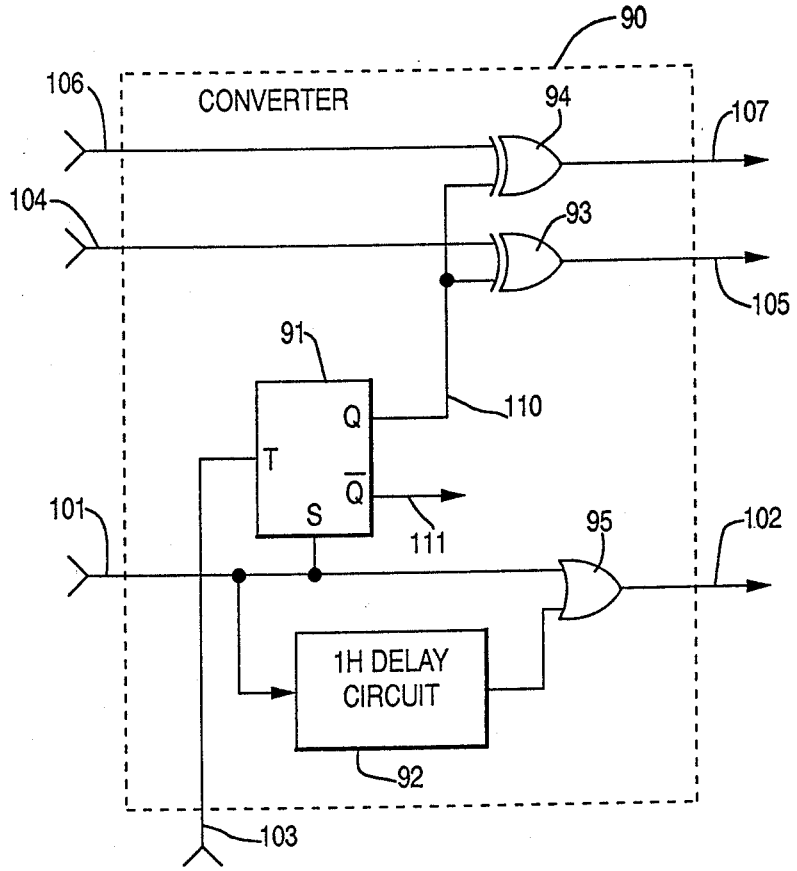
FIG. 7 is a circuit diagram showing an exemplary configuration of a converter in the apparatus of FIG. 4.

An example of configuration of a converter 90 is shown in FIG. 7. A T-flip-flop 91 is initialized (set) by the vertical sync signal 101 and triggered by the horizontal sync signal 103 to produce at its Q output terminal an inverting signal 110 which is a pulse train inverting periodically at intervals of horizontal scanning period. A 2-input exclusive-OR gate 94 receives the data 106 and the inverting signal 110 to obtain the periodically-inverted data 107 which inverts at every other horizontal scanning period. Referring to FIG. 5, data 2, 4, . . . , $n+1$, $n+3$, $n+5$, . . . are inverted to be $\overline{2}$, $\overline{4}$, . . . , $\overline{n+1}$, $\overline{n+3}$, $\overline{n+5}$, . . . . A 2-input exclusive-OR gate 93 receives the periodic pulse train 104 and the inverting signal 110 to halve the frequency of the pulse train 104 to obtain a periodic pulse train 105. This pulse train 105 is used for producing an AC signal necessary for driving the optical modulation material pixels as will be described later. The vertical sync signal 101 is delayed by one horizontal scanning period (1H) by a delay circuit 92. An OR gate 95 receives the vertical sync signal 101 and the 1H-delayed vertical sync signal to obtain both of the two signal as a signal 102 which is used for selecting two scanning lines at the same time as will be described later.

Referring back to FIG. 4, the scanning line driver comprises a shift register 61 for shifting the signal 102 in response to the horizontal sync signal 103 to obtain selection signals (or scanning signals) 112 for sequentially selecting the scanning lines, and an analog multiplexer 62 for multiplexing the driving voltages 0, $V_0$, $4V_0$ and $5V_0$ according to the selection signals 112 and the periodic pulse train 105 to obtain the voltages applied to the scanning lines. As shown in FIG. 5, each adjacent two of the selection signals (output signals of each adjacent two output terminals of the shift register 61) 112 overlap each other at respective later and earlier half duration thereof, so that each adjacent two scanning lines are selected at the same time during the overlapping time of the two adjacent selection signals. That is, during the earlier half duration of a selection signal n for selecting a scanning line n the scanning line n and the previous scanning line $n-1$ are selected at the same time, and during the later half duration of the selection signal n the scanning line n and the next scanning line $n+1$ are selected at the same time. The analog multiplexer 62 operates according to a truth table shown in FIG. 6(*a*). The period when a selection signal 112 is "1" is the selection period ($T_S$), and the period when the selection signal is "0" is the non-selection period. During the selection period, the output of the multiplexer 62 first becomes one of two voltages 0 and $5V_0$ and then changes to the other according to value of the signal 105. During the non-selection period, the output of the multiplexer 62 changes alternately from one of two voltages $V_0$ and $4V_0$ to the other.

The signal line driver 70 comprises a shift register 71 for shifting the periodically-inverted data 107 in response to the clock signal 108, a latch circuit 72 for latching output data of the shift register 71 in response to the horizontal sync signal 103, and an analog multiplexer 73 for multiplexing the driving voltages 0, $2V_0$, $3V_0$ and $5V_0$ according to output data of the latch circuit 72 and the signal 105 to obtain the voltages applied to the signal lines. The multiplexer 73 operates according to a truth table shown in FIG. 6(*b*). When the output data of the latch circuit 72 (i.e. the periodically-inverted data 107) is "0", the output of the multiplexer 73 first becomes one of two voltages $2V_0$ and $3V_0$ and then changes to the other according to the value of the signal 105. When the output data of the latch circuit 72 (i.e. the data 107) is "1" , the output of the multiplexer 73 first becomes one of two voltages 0 and $5V_0$ and then changes to the other according to the value of the signal 105.

As described above, the voltages shown in FIG. 3 can be generated by the apparatus shown in FIG. 4. For increasing the number of scanning lines selected at the same time, the 1H delay circuit 92 in FIG. 7 may be replaced by a plurality of 1H delay circuits connected in series and the 2-input OR gate 95 may be replaced by a multiple-input OR gate connected at its input terminals to respective outputs of the plurality of 1H delay circuits. Further, the values of the six kinds of driving voltages can be chosen arbitrarily. Furthermore, the whole configuration of the apparatus shown in FIG. 4 can be modified or changed in various manners to perform the same functions as described above.

Figure 8:
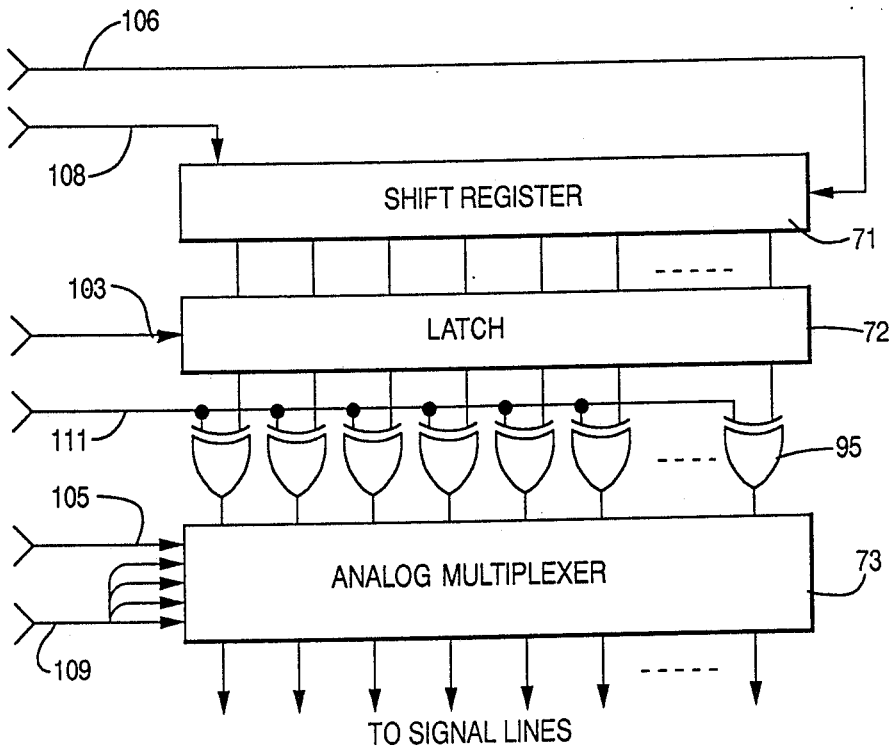
FIG. 8 is a block diagram showing a modified configuration of the signal line driver in the apparatus of FIG. 4.

For example, the display apparatus in FIG. 4 may be modified in such a way that the exclusive-OR gate 94 in the conver 90 shown in FIG. 7 is omitted and the signal driver 70 is replaced by a configuration shown in FIG. 8. The data 106 to be displayed are applied through the shift register 71 to the latch circuit 72. The output data of the latch circuit 72 are periodically inverted by exclusive-OR gates 95 according to an inverting signal 111 appearing at the $\overline{Q}$ output terminal of the T-flip-flop 91 thereby obtaining the periodically-inverted data 107.

What is claimed is:

1. A method of driving an optical modulation device forming pixels in a matrix between scanning lines and signal lines, comprising the steps of:

dividing a selection period in which a scanning line is selected into at least four division periods;

applying a voltage to each pixel connected to the selected scanning line in such a manner that each pixel becomes a first stable state of its bistable states during third and second division periods counted from the last division period in the selection period, and either becomes a second stable state of the bistable states or holds the first stable state during the last division period according to data to be displayed; and applying a voltage for holding a stable state established during the selection period to each pixel during a non-selection period in which the scanning line is not selected.

2. The method as in claim 1, wherein each of the division periods is at most a half of a horizontal scanning period.

3. The method as in claim 1, the voltage applied to each of the pixels is a DC voltage in each of the division periods.

4. The method as in claim 1, wherein the voltage applied to each of the pixels is same in polarity during the third and second division periods counted from the last division period in each selection period.

5. The method as in claim 1, wherein the optical modulation device is a ferroelectric liquid crystal.

6. The method of driving an optical modulation device forming pixels in a matrix between scanning lines and signal lines, characterized by scanning to select the scanning lines sequentially while selecting at least two sequential scanning lines at the same time, wherein each of the pixels is driven in the steps of:

dividing a selection period in which a scanning line is selected into at least four division periods;

applying a voltage to each pixel connected to the selected scanning line in such a manner that each pixel becomes a first stable state of its bistable states during third and second division periods counted from the last division period in the selection period, and either becomes a second stable state of the bistable states or holds the first stable state during the last division period according to data to be displayed; and applying a voltage for holding a stable state established during the selection period to each pixel during a non-selection period in which the scanning line is not selected.

7. The method as in claim 6, wherein each of the division periods is at most a half of a horizontal scanning period.

8. The method as in claim 6, the voltage applied to each of the pixels is a DC voltage in each of the division periods.

9. The method as in claim 6, wherein the voltage applied to each of the pixels is same in polarity during the third and second division periods counted from the last division period in each selection period.

10. The method as in claim 6, wherein the optical modulation device is a ferroelectric liquid crystal.

11. The method as in claim 6, wherein the data to be displayed are inverted at every other horizontal scanning period before being converted to voltages applied to the signal lines.

12. A method of driving an optical modulation device forming pixels in a matrix between scanning lines and signal lines, the total number of the scanning lines being N, characterized by scanning to select the scanning lines sequentially while selecting $k+1$ scanning lines at the same time in the sequence of first through k-th scanning lines. second through $(k+2)$-th scanning lines, . . . , n-th through $(n+k)$-th scanning lines, . . . , where k is any integer of $k<<N$, wherein each of the pixels is driven in the steps of:

dividing a selection period $T_S$ in which a scanning line is selected into a least $2(k+1)$ division periods each being $\tau$ satisfying a condition of $H \geqq 2\tau$, where H is a horizontal scanning period;

applying a voltage to each pixel connected to the selected scanning line in such a manner that each pixel becomes a first stable state of its bistable states during third and second division periods counted from the last division period in the selection period, and either becomes a second stable state of the bistable states or holds the first stable state during the last division period according to data to be displayed; and applying an alternating voltage for holding a stable state established during the selection period to each pixel during a non-selection period in which the scanning line is not selected.

13. The method as in claim 12, wherein the voltage applied to each of the pixels is a DC voltage in each of the division periods.

14. The method as in claim 12, wherein the voltage applied to each of the pixels is same in polarity during the third and second division periods counted from the last division period in each selection period.

15. The method as in claim 12, wherein the optical modulation device is a ferroelectric liquid crystal.

* * * * *